US005504976A

United States Patent [19]

Reeves

[11] Patent Number: 5,504,976

[45] Date of Patent: Apr. 9, 1996

[54] DEVICE FOR MOUNTING INSIGNIA ON CLOTHING

[75] Inventor: Robert J. Reeves, Attleboro, Mass.

[73] Assignee: Reeves Co., Inc., Attleboro, Mass.

[21] Appl. No.: 300,788

[22] Filed: Sep. 2, 1994

[51] Int. Cl.[6] ..... A44C 3/00; A47G 1/12; A44B 21/00

[52] U.S. Cl. ..... 24/3.1; 40/1.5

[58] Field of Search ..... 24/3.1, 3.5, 3.11, 24/3.12, 545, 555, 563; 40/1.5, 658, 666, 588; 248/231.8, 231.7, 305, 309.1, 902

[56] References Cited

U.S. PATENT DOCUMENTS

| | | | |
|---|---|---|---|
| 2,881,766 | 4/1959 | Tornsjo | 24/563 X |
| 3,175,317 | 3/1965 | Slavsky | 40/1.5 |
| 3,237,326 | 3/1966 | Naffin | 40/1.5 |
| 3,280,488 | 10/1966 | Rubin | 40/1.5 |
| 3,462,863 | 6/1967 | Reeves | 40/1.5 |

*Primary Examiner*—Peter M. Cuomo
*Assistant Examiner*—Robert J. Sandy
*Attorney, Agent, or Firm*—Salter & Michaelson

[57] ABSTRACT

A device for mounting insignia, such as an embossed name plate, in a pocket of an article of clothing consists of a one-piece member including first and second spaced locating members and a clamping member which is integrally formed with the second locating member. The first locating member includes an inwardly facing locating surface having a laterally extending rounded hump thereon. The clamping member extends outwardly and upwardly from the second locating member toward the first locating member wherein a head portion thereof makes biased contact with the locating surface. The clamping member is biased toward the locating surface by means of an integrally formed curved torsion bar having an axis of flexure spaced away from the locating surface and extending in the direction of the lateral hump. The torsion bar is arcuate in shape and has symmetrical end portions which are arranged parallel to the axis of flexure thereby permitting bending flexure about the axis. The head portion includes a rectangular opening which interfittingly engages with the lateral hump on the locating surface. The hump and rectangular opening cooperate to securely capture a piece fabric positioned therebetween, and effectively prevent movement of the fabric once the device is secured in position.

8 Claims, 2 Drawing Sheets

DEVICE FOR MOUNTING INSIGNIA ON CLOTHING

BACKGROUND AND SUMMARY OF THE INVENTION

The instant invention relates to mounting devices and more particularly to a clip-type mounting device for mounting insignia in a pocket of an article of clothing.

Mounting devices of the type contemplated have heretofore been known in the art. In this regard, the Applicant's U.S. Pat. No. 3,462,863 represents the closest prior art to the subject invention of which the Applicant is aware. The '863 patent discloses a mounting device including first and second face-to-face locating members and a clamping member which extends outwardly from the second locating member and makes biased engagement with the first locating member by means of a lateral torsion bar arranged for twisting flexure. An insignia is mounted to the face of the first locating member. The piece of fabric forming a pocket of an article of clothing is positioned between the first locating member and the clamping member wherein the fabric is held therebetween by means of biased clamping pressure. The faces of the first mounting member and the clamping member are knurled to provide additional friction.

While the above device adequately maintains itself in position within a pocket, it has been found that the spring torsion of the clamping member gradually becomes reduced through repeated opening and closing thereof. In this connection, it is pointed out that the ends of the laterally extending torsion bar are arranged perpendicular to the axis of flexure. This twisting type arrangement has been found to cause rapid deformation of the torsion bar. When the spring torsion becomes reduced, the mounting device becomes less effective for maintaining the insignia in position. It has also been found that the knurled surfaces of the locating member and clamping member are not always adequate for securely capturing a piece of fabric positioned therebetween.

Accordingly, among the several objects of the instant invention are: the provision of a mounting device with an improved torsion bar having increased torque, i.e. clamping pressure; the provision of a torsion bar which does not readily lose its clamping pressure even after repeated use; and the provision of a mounting device having an improved clamping arrangement for more securely holding a piece of fabric therein.

The above objects are accomplished by providing a one-piece mounting device including first and second spaced locating members and a clamping member which is integrally formed with the second locating member. The first locating member includes an inwardly facing locating surface having a laterally extending hump. The clamping member extends outwardly and upwardly from the second locating member toward the first locating member wherein a head portion thereof makes biased engagement with the locating surface. The clamping member is biased toward the locating surface by an integrally formed curved torsion bar having an axis of flexure spaced away from the locating surface and extending in the direction of the lateral hump. More specifically, the torsion bar is arcuate in shape and has symmetrical end portions which are disposed parallel to the axis of flexure thereby permitting bending flexure about the axis. The head portion includes a rectangular opening which interfittingly engages with the hump on the locating surface. In this regard, the hump and rectangular opening cooperate to securely trap a piece of fabric positioned therebetween.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
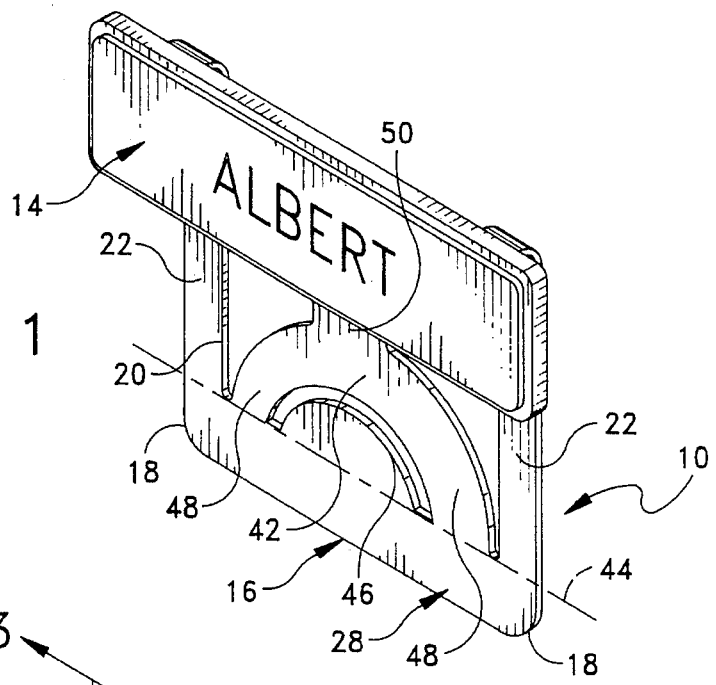
FIG. 1 is a front perspective view of the instant mounting device.

Referring now to the drawings, the mounting device of the instant invention is illustrated and generally indicated at 10 in FIGS. 1–6. As will hereinafter be more fully described, mounting device 10 is mountable on a piece of fabric 12 forming a pocket of an article of clothing for mounting an insignia, such as a name plate generally indicated at 14, thereon.

Mounting device 10 is formed from a unitary, generally rectangular piece of thin anodized aluminum, generally indicated at 16, colored as desired. The corners 18 of rectangular piece of metal 18 are rounded to remove sharp edges which may snag clothing fabric. The piece of metal 18 is cut out at 20 to form outer spaced arm portions 22 and an inner clamping member generally indicated at 24. The piece of metal 16 is reversely bent at one end to provide a shorter first locating member generally indicated at 26 and a longer second locating member generally indicated at 28. Locating members 26 and 28 are integrally connected by spaced arm portions 22. Clamping member 24 extends outwardly and upwardly from second locating member 28 so that it is positioned between arm portions 22. First locating member 26 includes a locating surface 30 which faces inwardly toward second locating member 28. Locating surface 30 is provided with a raised surface portion 32. More specifically, raised surface 32 comprises a laterally extending rounded hump. Hump 32 is preferably formed by cutting a flap in first locating member 30 and then bending the flap in a rounded configuration. Insignia 14 is securable to an outwardly facing surface 34 of first locating member 26 by means of rivets 36 which extend through apertures (not shown) therein, or by other suitable means.

Clamping member 24 extends outwardly and upwardly from second locating member 28 toward first locating member 26 wherein an integral head portion 38 makes biased engagement with locating surface 30. Engagement of head portion 38 with locating surface 30 provides a downwardly facing, wedge shaped fabric receiving space generally indicated at 40 (See FIGS. 3, 4 and 6). Clamping member 24 is resiliently biased toward first locating member 26 by an integral torsion bar 42 disposed within a plane 43 and having an axis of flexure 44 spaced from first locating member 26 and extending in the direction of the lateral hump 32. The lower curved edge of torsion bar 42 is defined by a curved cut out 46. Torsion bar 42 includes two symmetrical ends 48 which are arranged parallel to the axis of flexure 44 for bending flexure about axis 44. The plane 43 intersects the axis of flexure 44 such that the ends 48 of the torsion bar 42 extend upwardly and outwardly in an arcuate configuration from the axis of flexure 44 within the plane 43. Curved torsion bar 42 provides an advantage over the prior art lateral torsion bar in that plastic deformation of ends 48 is greatly reduced compared with a twisting flexure arrangement. Head portion 38 of clamping member 24 is connected to a central portion of torsion bar 42 by a rigid neck 50. Clamping member 24 further includes a distal thumb tab 52 which extends slightly above the reverse bend in the spaced arm portions 22.

Figure 2:
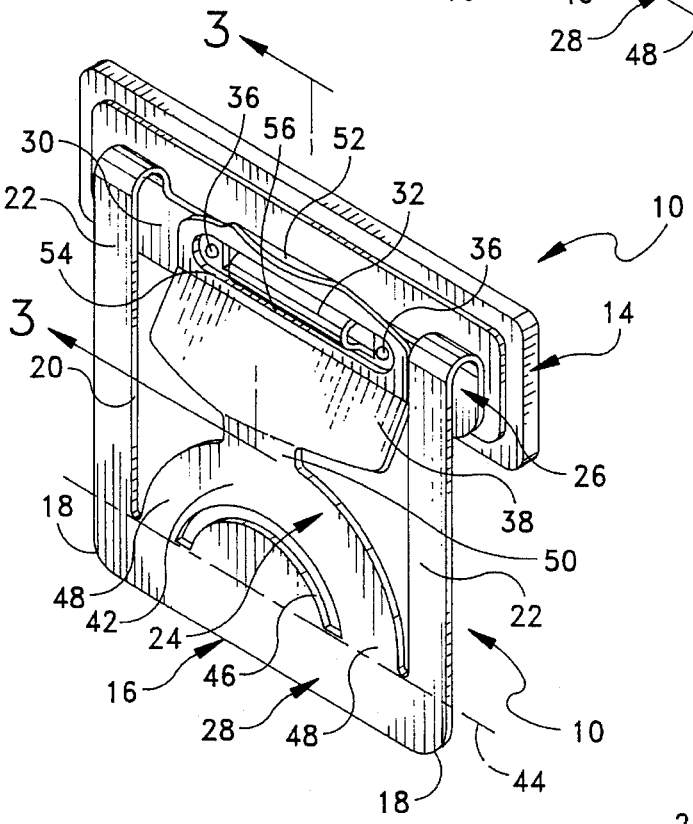
FIG. 2 is a rear perspective view thereof.
Figure 3:
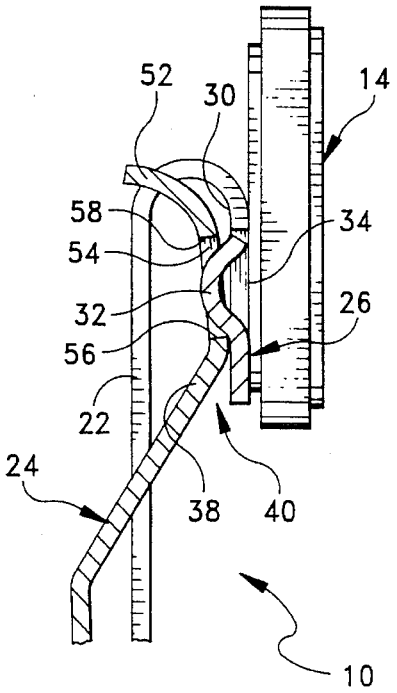
FIG. 3 is a cross-sectional view thereof taken along line 3—3 of FIG. 2.

Referring now to FIGS. 2 and 3, it can be seen that raised hump 32 on locating surface 30 is interfittingly received into a corresponding elongated opening 54 in head portion 38. More specifically, the lower edge 56 of opening 54 firmly engages a lower edge of hump 32 while the upper edge 58 of opening 54 is positioned in spaced relation to the upper edge of hump 32 (see FIG. 3).

Figure 5:
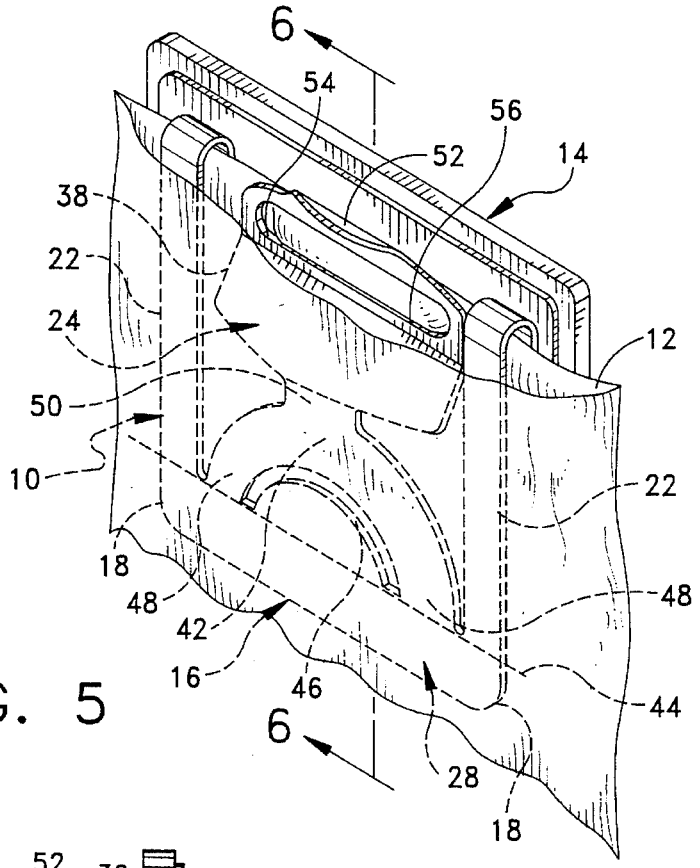
FIG. 5 is rear perspective view showing the mounting device mounted in a pocket.
Figure 4:
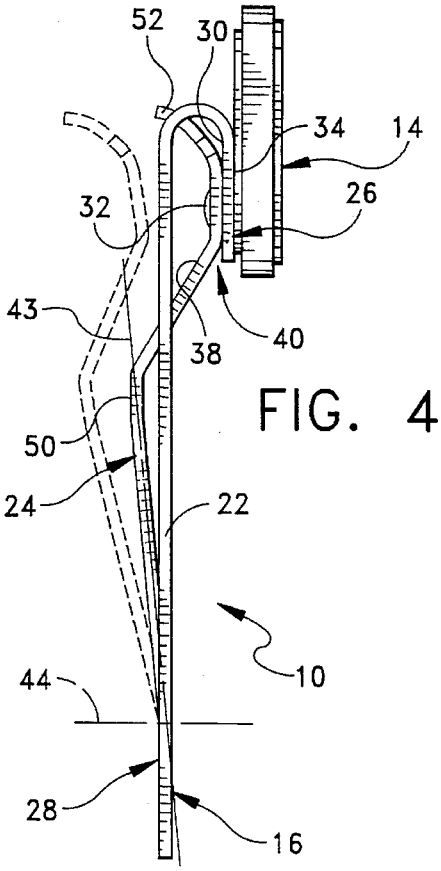
FIG. 4 is a side view thereof.
Figure 6:
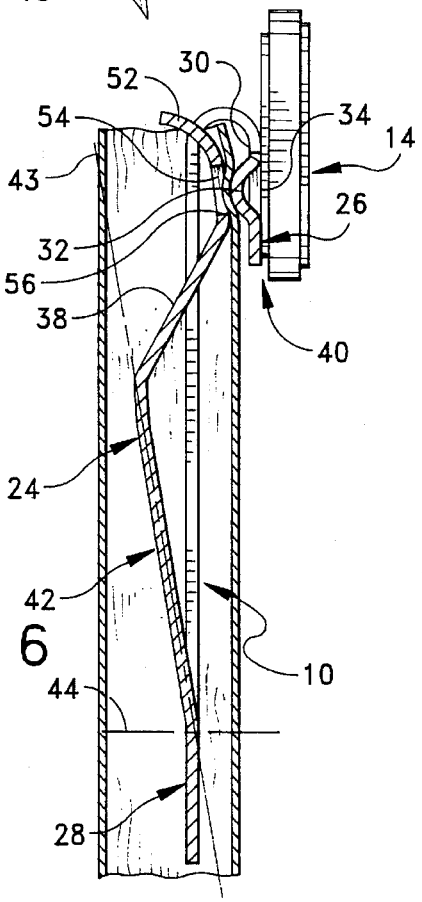
FIG. 6 is a cross-section view thereof taken along line 6—6 of FIG. 5.

In operation, the longer second locating member 28 is inserted into a pocket, with fabric 12 passing into the wedge-shaped space 40 between locating member 26 and head 38 (see FIGS. 5 and 6). Clamping member 24 bends slightly about axis 44 to accommodate for the thickness of fabric 12, yet remains resiliently biased toward the locating member 26 to capture fabric 12 therebetween. In this connection, raised hump 32 and rectangular opening 54 cooperate to firmly capture fabric 12 therebetween. More specifically, fabric 12 is firmly captured between bottom edge 56 of opening 54 and a bottom edge of hump 32. Upper edge 58 of opening 54 is spaced from hump 32 to allow the bottom edge 56 to firmly engage fabric 12. Locating member 28 securely positions mounting device 10 within the pocket and helps to reduce sag of the pocket material 12. The device 10 may be easily removed by actuating thumb tab 52 to relieve clamping pressure against fabric 12.

It can therefore be seen that the instant invention provides an improved mounting device 10 for mounting insignia in a pocket of an article of clothing. Lateral hump 32 on locating member 26 and opening 54 in head 38 of clamping member 24 cooperate to securely capture fabric 12 therebetween. This arrangement effectively prevents movement of the fabric 12 once the device 10 is secured in position. The curved arrangement of the torsion bar 42 permits bending flexure at the ends 48 of the torsion bar 42 instead of twisting flexure as shown in the prior art. The bending flexure of the instant invention reduces deformation of the torsion bar 42 as it is repeatedly actuated, thereby resulting in a longer lasting product. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A device for mounting insignia on an article of clothing comprising:

a first locating member including a locating surface having a raised surface portion thereon;

a second locating member, said first and second locating members being positioned in generally parallel spaced relation so that said locating surface faces said second locating member; and a clamping member extending outwardly and upwardly from said second locating member toward said locating surface wherein a head portion of said clamping member resiliently engages said locating surface, said clamping member being biased toward said locating surface by an integral arcuate torsion bar disposed within a predetermined plane and having an axis of flexure spaced from said locating surface and extending in the direction of said raised surface portion, said torsion bar having terminal ends arranged within said axis of flexure for bending flexure about said axis, said plane intersecting said axis of flexure such that said torsion bar extends upwardly and outwardly in an arcuate configuration from said axis of flexure within said plane, said raised surface portion of said locating surface interfittingly engaging with a corresponding opening formed in said head portion.

2. In the mounting device of claim 1, said raised surface portion comprising a laterally extending hump.

3. In the mounting device of claim 2, said opening in said head portion comprising anlongated opening having a greater length than said hump.

4. In the mounting device of claim 3, said rectangular opening having upper and lower edges, said lower edge engaging a lower edge of said hump, said upper edge being spaced from an upper edge of said hump.

5. In the mounting device of claim 1, said second mounting member and said clamping member being integrally formed from a unitary piece of thin metal.

6. In the mounting device of claim 1, said first and second locating members being integrally formed from a unitary piece of thin metal, said piece of thin metal being reversely bent to form said first locating member and said second locating member.

7. A mounting device for mounting insignia on an article of clothing comprising:

a first locating member including a locating surface;

a second locating member, said first and second locating members being positioned in generally parallel spaced relation so that said locating surface faces said second locating member; and a clamping member extending outwardly and upwardly from said second locating member toward said locating surface wherein a head portion of said clamping member resiliently engages said locating surface, said clamping member being biased toward said locating surface by an integral arcuate torsion bar disposed within a predetermined plane and having an axis of flexure spaced from said locating surface and extending in the direction of said raised surface portion, said torsion bar comprising an arcuate upwardly curved bar having symmetrical end portions arranged within said axis of flexure for bending flexure about said axis, said plane intersecting said axis of flexure such that said torsion bar extends upwardly and outwardly in an arcuate configuration from said axis of flexure within said plane, said head portion being connected to said torsion bar by a rigid neck.

8. In the mounting device of claim 7, said second locating member and said clamping member being integrally formed from a unitary piece of thin metal.

* * * * *